US008485421B2

(12) United States Patent
Bull

(10) Patent No.: US 8,485,421 B2
(45) Date of Patent: Jul. 16, 2013

(54) APPARATUS PERTAINING TO A SINGLE-PIECE BLANK AND A CORRESPONDING CLAMSHELL-STYLE CARTON

(75) Inventor: Nicholas R. Bull, Ossining, NY (US)

(73) Assignee: Kraft Foods Group Brands LLC, Northfield, IL (US)

( * ) Notice: Subject to any disclaimer, the term of this patent is extended or adjusted under 35 U.S.C. 154(b) by 575 days.

(21) Appl. No.: 12/728,836

(22) Filed: Mar. 22, 2010

(65) Prior Publication Data

US 2010/0237139 A1 Sep. 23, 2010

Related U.S. Application Data

(60) Provisional application No. 61/162,517, filed on Mar. 23, 2009.

(51) Int. Cl.
*B65D 5/48* (2006.01)
*B65D 25/04* (2006.01)

(52) U.S. Cl.
USPC ..... 229/120.09; 229/120.18; 229/120.21; 229/172; 229/178

(58) Field of Classification Search
USPC ..... 229/120.09, 120.13, 120.17, 120.18, 229/120.21, 146, 172, 178, 930
See application file for complete search history.

(56) References Cited

U.S. PATENT DOCUMENTS

| | | | | |
|---|---|---|---|---|
| 1,046,398 | A * | 12/1912 | Morrison et al. | 229/146 |
| 1,482,569 | A * | 2/1924 | Lange | 229/930 |
| 1,565,765 | A * | 12/1925 | Walter | 229/122.26 |
| 1,899,772 | A * | 2/1933 | Richardson | 229/120.09 |
| 1,983,689 | A * | 12/1934 | Bedell | 229/117.14 |
| 2,421,225 | A | 5/1947 | Stensgaard | |
| 2,603,405 | A * | 7/1952 | Frankenstein | 229/146 |
| 2,852,177 | A * | 9/1958 | Frasch | 229/146 |
| 3,744,700 | A | 7/1973 | Stegmann | |
| 4,002,287 | A | 1/1977 | Saveth | |
| 4,102,557 | A | 7/1978 | Lee et al. | |
| 4,227,759 | A | 10/1980 | Lee et al. | |
| 4,360,115 | A | 11/1982 | Saunders | |
| 4,930,681 | A * | 6/1990 | Fultz et al. | 229/146 |
| 5,303,823 | A | 4/1994 | Niles et al. | |
| 5,445,314 | A | 8/1995 | Newsome | |
| 5,501,351 | A | 3/1996 | Niles et al. | |
| 5,505,372 | A | 4/1996 | Edson et al. | |

(Continued)

FOREIGN PATENT DOCUMENTS

| | | |
|---|---|---|
| DE | 4218408 | 12/1992 |
| EP | 0 366 012 | 5/1990 |

OTHER PUBLICATIONS

Canadian Patent Application No. 2,697,419; Office Action Dated Apr. 13, 2012.

*Primary Examiner* — Gary Elkins
(74) *Attorney, Agent, or Firm* — Fitch, Even, Tabin & Flannery LLP

(57) ABSTRACT

A single-piece blank forms a clamshell-style carton. This single-piece blank includes a plurality of fold lines. These fold lines are oriented and positioned such that folding the single-piece blank along the plurality of fold lines forms this clamshell-style carton. The resultant carton will tend to have a first compartment and a second compartment. Both compartments comprise corresponding storage areas of approximately equal size and both also share a particular fold line that also serves as a hinged edge.

19 Claims, 13 Drawing Sheets

U.S. PATENT DOCUMENTS 5,542,598 A 8/1996 Capo
5,582,312 A 12/1996 Niles et al.
5,722,584 A 3/1998 Fujiwara
5,881,884 A 3/1999 Podosek
5,904,262 A 5/1999 Coppi
6,053,346 A 4/2000 Niles et al.
6,055,713 A 5/2000 Genei
6,193,090 B1 2/2001 Connors et al.
6,209,786 B1 4/2001 Yelton et al.
6,223,922 B1 5/2001 Amatangelo
6,270,006 B1 8/2001 Bright et al.
6,435,351 B1 8/2002 Gibb
6,474,542 B1 11/2002 Chagnon et al.
6,510,982 B2 1/2003 White et al.
6,578,736 B2 6/2003 Spivey
6,715,639 B2 4/2004 Spivey
6,902,104 B2 6/2005 Holley, Jr. et al.
6,918,487 B2 7/2005 Harrelson
6,929,172 B2 8/2005 Bates et al.
6,968,992 B2 11/2005 Schuster
6,976,588 B2 12/2005 Wischusen et al.
6,981,631 B2 1/2006 Fogle et al.
7,000,824 B2 2/2006 Saulas
7,100,798 B2 9/2006 Spivey
7,102,468 B2 9/2006 Otsuka et al.
7,104,435 B2 9/2006 Holley, Jr.
7,147,143 B2 12/2006 Cargile
7,175,047 B2 2/2007 Spivey
7,207,474 B2 4/2007 Holley, Jr.
7,328,798 B2 2/2008 Auclair et al.
7,331,509 B2 2/2008 Bates et al.
7,374,043 B2 5/2008 Holley, Jr. et al.
7,380,701 B2 6/2008 Fogle et al.
7,401,711 B2 7/2008 Spivey, Sr.
7,467,713 B2 12/2008 Harrelson
7,568,611 B2 8/2009 Cargile, Jr.
7,568,612 B2 8/2009 Ho Fung et al.
7,604,157 B2 10/2009 Zammit et al.
7,614,497 B2 11/2009 Spivey, Sr.
2002/0088820 A1 7/2002 Spivey
2002/0108950 A1 8/2002 Moorman et al.
2003/0192907 A1 10/2003 Bates
2004/0089671 A1 5/2004 Miller
2004/0159671 A1 8/2004 Spivey
2004/0188508 A1 9/2004 Holley, Jr. et al.
2004/0188509 A1 9/2004 Holley, Jr.
2005/0023333 A1 2/2005 Cargile
2005/0056658 A1 3/2005 Rudolph Spivey
2005/0224565 A1 10/2005 Holley
2005/0269389 A1 12/2005 Bates et al.
2006/0065703 A1 3/2006 DeBusk et al.
2006/0071058 A1 4/2006 Spivey, Sr.
2006/0081492 A1 4/2006 Holley, Jr. et al.
2006/0091191 A1 5/2006 DeBusk
2006/0091193 A1 5/2006 DeBusk et al.
2006/0131370 A1 6/2006 Bates
2006/0175386 A1 8/2006 Holley, Jr.
2006/0231604 A1 10/2006 DeBusk et al.
2006/0255114 A1 11/2006 Hand et al.
2006/0261140 A1 11/2006 Holley, Jr.
2007/0007325 A1 1/2007 Suzuki et al.
2007/0017966 A1 1/2007 DeBusk et al.
2007/0063005 A1* 3/2007 Gomes et al. ..... 229/120.09
2007/0069002 A1 3/2007 Gomes et al.
2007/0080083 A1 4/2007 Holley, Jr.
2007/0090175 A1 4/2007 Schemmel
2007/0164093 A1 7/2007 Spivey, Sr. et al.
2007/0170232 A1 7/2007 Spivey
2007/0228133 A1 10/2007 Ho Fung et al.
2007/0257096 A1 11/2007 Coltri-Johnson
2007/0295789 A1 12/2007 Ho Fung
2007/0295790 A1 12/2007 Zammit et al.
2007/0295791 A1 12/2007 Gomes et al.
2007/0295792 A1 12/2007 Zammit et al.
2008/0116251 A1 5/2008 Gomes et al.
2008/0156859 A1* 7/2008 Glasgow ..... 229/120.18
2008/0245850 A1 10/2008 Spivey
2009/0065388 A1 3/2009 Harrelson
2009/0121003 A1 5/2009 Garner
2009/0121006 A1 5/2009 Gasior
2009/0173749 A1 7/2009 Spivey
2009/0272793 A1 11/2009 Ho Fung et al.

* cited by examiner

APPARATUS PERTAINING TO A SINGLE-PIECE BLANK AND A CORRESPONDING CLAMSHELL-STYLE CARTON

RELATED APPLICATION(S)

This application claims the benefit of U.S. Provisional application No. 61/162,517, filed Mar. 23, 2009, which is incorporated by reference in its entirety herein.

TECHNICAL FIELD

This invention relates generally to paperboard cartons.

BACKGROUND

Cartons formed of paperboard comprise a well known area of prior art endeavor. In many cases the carton has a bottom container portion formed from a first single-piece blank and a corresponding cover portion formed from a second, physically-discrete single-piece blank. Generally speaking, while lighter-weight single-layer paperboard will suffice for light-weight duty (when storing, for example, a light-weight item of clothing), such cartons are formed using corrugated cardboard when anticipating heavier-duty applications.

Unfortunately, paperboard such as corrugated cardboard is typically more expensive than single-layer paperboard products. Transportation costs and storage requirements are also greater owing to the increased size of such a material as compared to a single-layer paperboard product. Though such inefficiencies can appear small when comparing two cartons side by side, these costs can grow to significant size when considered in bulk.

BRIEF DESCRIPTION OF THE DRAWINGS

The above needs are at least partially met through provision of the apparatus pertaining to a single-piece blank and a corresponding clamshell-style carton described in the following detailed description, particularly when studied in conjunction with the drawings, wherein.

Figure 1:
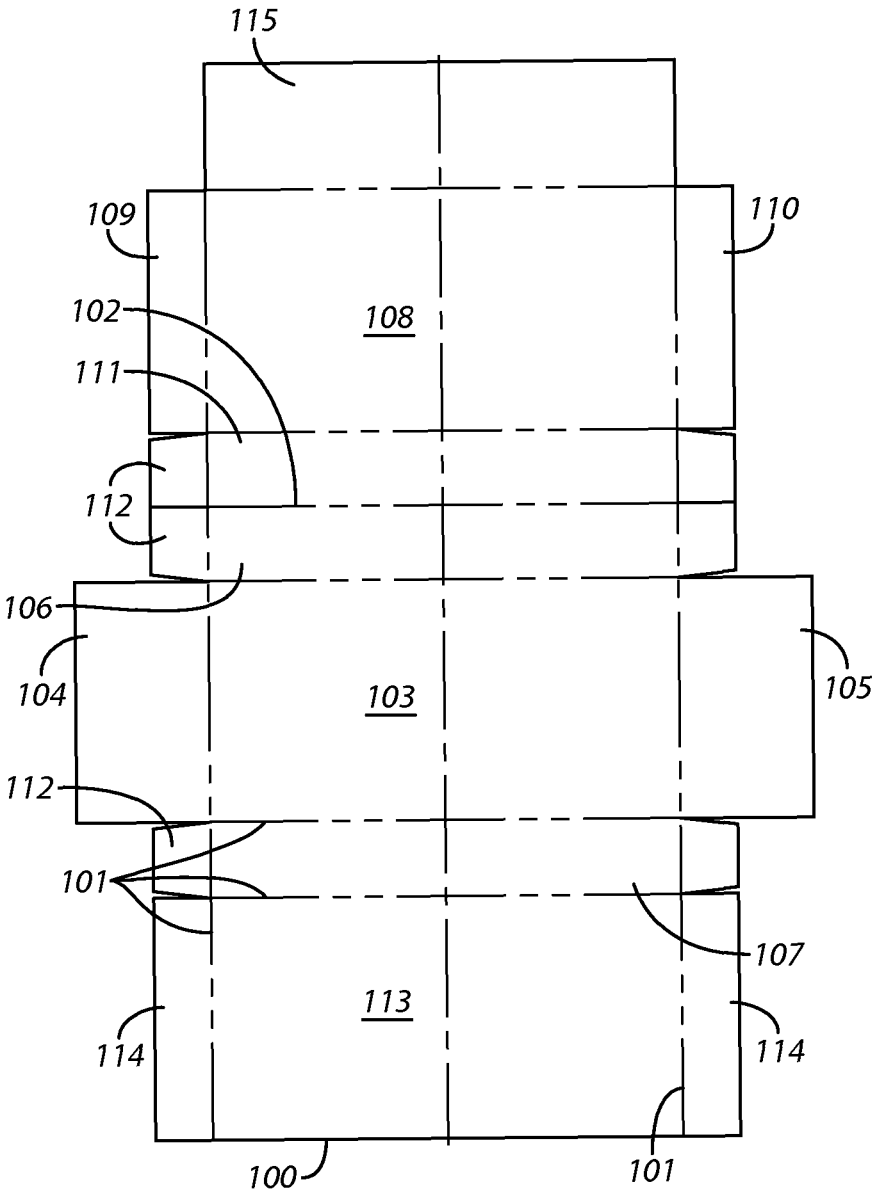
FIG. 1 comprises a top plan view as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a single-piece blank forms a clamshell-style carton. This single-piece blank includes a plurality of fold lines. These fold lines are oriented and positioned such that folding the single-piece blank along the plurality of fold lines forms this clamshell-style carton. The resultant carton will tend to have a first compartment and a second compartment. Both compartments comprise corresponding storage areas of approximately equal size and both also share a particular fold line that also serves as a hinged edge.

By one approach, these teachings will readily permit the use of paperboard, including non-corrugated paperboard, for the single-piece blank. A water-resistant coating can be disposed on one or both sides of the blank as desired.

These teachings will readily accommodate a wide variety of variations. As one example in these regards, the first compartment can include a top panel that folds over to substantially cover the first compartment storage area and that will also serve as a top panel for the second compartment as well. As another example in these regards, the second compartment can include an additional side panel that folds over to substantially enclose the second storage area. As yet another example in these regards, at least one side panel of one or both of the aforementioned compartments can be sufficiently large so as to substantially overlap with an opposing side panel when the carton is closed. As yet another example in these regards, the second compartment can further include a side panel having hinged wing panels that fold down over the end panels when the carton is closed. And as yet another example in these regards, at least one of the end panels for these compartments can comprise a double-fold end panel.

So configured, a durable clamshell-style carton can be readily formed of a single single-layer blank. Notwithstanding the lack of corrugated materials, such a carton will readily serve a wide variety of packaging and shipping purposes. As such a carton will readily substitute for a corrugated-material carton in a wide variety of application settings, considerable savings are achieved. Those skilled in the art will recognize that such a carton will serve as a useful and adequate container for a wide variety of products and materials. It will also be recognized that these teachings are highly scalable and can be successfully applied with a wide variety of applied dimensions.

These and other benefits may become clearer upon making a thorough review and study of the following detailed description. Referring now to the drawings, various illustrative examples will be presented. (The single-piece blank presented in each of the following examples comprises non-corrugated paperboard having a water-resistant coating (such as a clay-based coating as is known in the art). More particularly, this paperboard has a thickness ranging from about 24 points to about 30 points. These examples will also be presented with specific dimensions and corresponding form factors. Those skilled in the art will recognize and understand that the specifics of such examples serves an illustrative purpose only and are not offered with any suggestion or intent that these specifics comprise an exhaustive listing of all such possibilities in this regard.)

FIG. 1 illustrates a single-piece blank 100 having a plurality of fold lines formed thereon. Some of these fold lines are denoted by reference numeral 101. If desired, these fold lines can simply comprise corresponding markings on the single-piece blank 100 such as, by way of example, printed lines. One or more of these fold lines can also comprise, in lieu of the foregoing or in combination therewith, a scored line. (Score lines are well known in the art and comprise an indention, groove, or the like formed in an otherwise flat surface. Such score lines typically greatly facilitate the ease, accuracy, and preferred directionality of forming a fold in such a surface. As the formation and use of score lines comprises a well-understood area of endeavor, further elaboration in these regards will not be presented here.)

In the example shown, all of the folds to be made in the single-piece blank 100 (with one notable exception) can be viewed as generally requiring the adjacent blank material to be raised upwardly (at least initially) towards the viewer on either side of the fold line (or, if you will, inwardly towards the compartment to be formed). The one exception comprises a particular fold line 102 that will serve, as described below, as a hinged edge. In this one case, if desired, the fold line 102 may comprise a reverse scored line to facilitate moving the material on either side of this fold line 102 away from the viewer rather than towards the viewer. As will become more apparent below, this hinged edge facilitates the clamshell-style opening and closing operability of the resultant carton.

Figure 2:
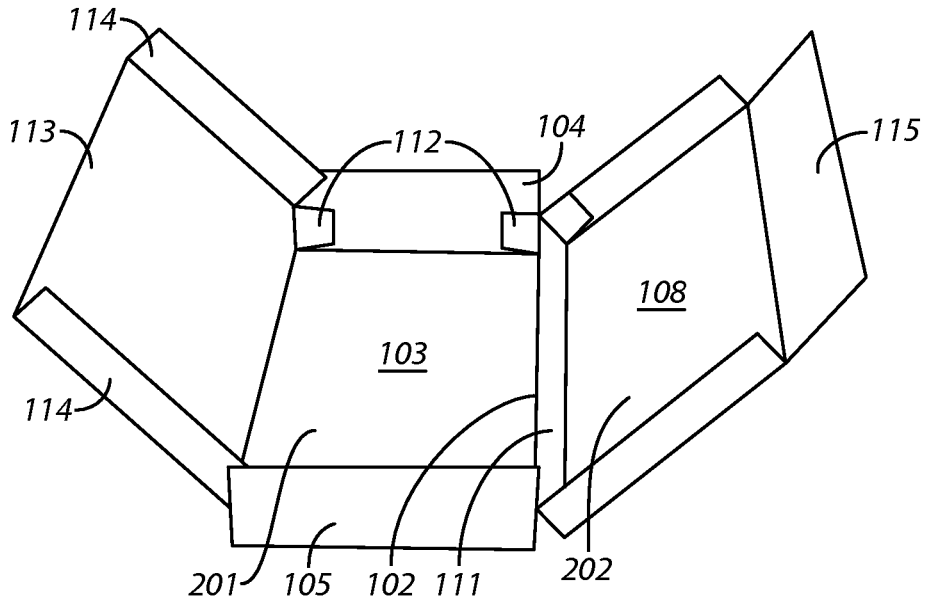
FIG. 2 comprises a perspective view as configured in accordance with various embodiments of the invention.

Referring momentarily to FIG. 2, when folded along the aforementioned fold lines, the single-piece blank 100 forms a first compartment 201 that comprises a first storage area and a second compartment 202 that comprises a second storage area. Referring now to both FIGS. 1 and 2, the first compartment 201 comprises a bottom panel 103, two opposing end panels 104 and 105, and two opposing side panels 106 and 107. Somewhat similarly, the second compartment 202 comprises a bottom panel 108, two opposing end panels 109 and 110, and, in this illustrative example, a side panel 111. As clearly shown in FIG. 1, the fold line 102 that joins one side panel 106 of the first compartment 201 to one side panel 111 of the second compartment 202 comprises the fold line that comprises the aforementioned hinged edge. As shown in FIG. 2, this configuration permits the first and second compartments 201 and 202 to move with respect to one another about this hinged edge in a clamshell style of movement.

To aid in retaining these various components of each compartment 201 and 202 in the described configuration, the single-piece blank 100 can further comprise a plurality of tabs (with some of these tabs being denoted by reference numeral 112). As shown in FIG. 2, these tabs 112 can be attached to an adjacent end panel 104, 105, 109, and 110) using, for example, an adhesive such as glue, a fastening member such as a staple or brad, or some other attachment mechanism as may be desired. The use of such tabs for such purposes comprises a known technique and requires no further elaboration here.

Figure 3:
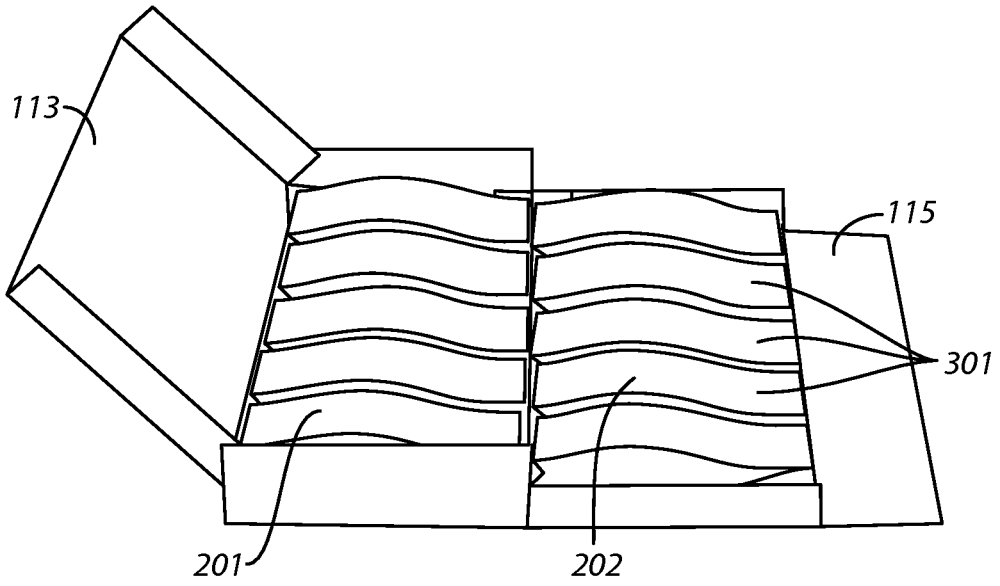
FIG. 3 comprises a perspective view as configured in accordance with various embodiments of the invention.

Referring now momentarily to FIG. 3, so configured, both the first and second compartments 201 and 202 can hold an essentially equal quantity of product. In this particular example, this product comprises a plurality of individually wrapped food items 301. Those skilled in the art will recognize that this product can comprise other items as well including non-edible items.

Figure 4:
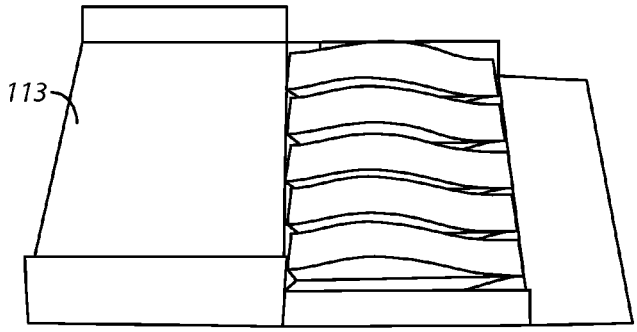
FIG. 4 comprises a perspective view as configured in accordance with various embodiments of the invention.

Referring now in particular to both FIG. 1 and FIG. 4, in this particular illustrative embodiment the first compartment 201 also comprises a top panel 113 that folds over to substantially cover the first storage area. As shown in FIGS. 1 and 2, side flaps 114 can be disposed on opposing ends of the top panel 113. These side flaps 114 can be disposed within the first compartment as shown in FIG. 4 when disposing this top panel 113 as shown. Such a configuration can aid, for example, in temporarily retaining the top panel 113 in a closed position while still permitting the top panel 113 to be easily selectively moved to an opened position when desired.

Figure 5:
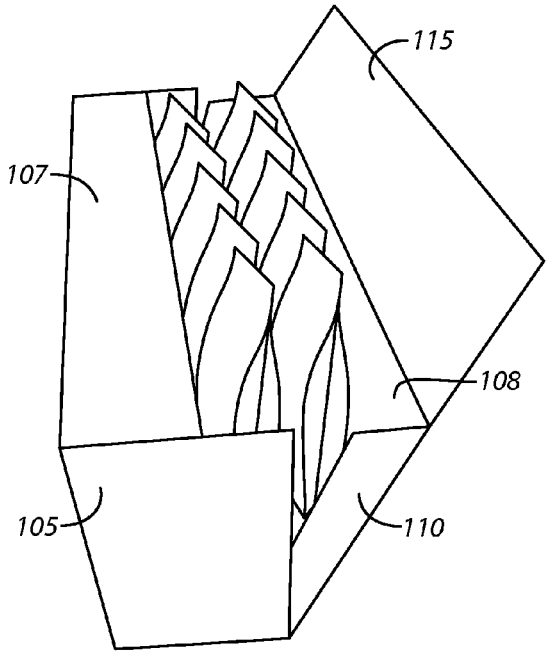
FIG. 5 comprises a perspective view as configured in accordance with various embodiments of the invention.

When the first compartment 201 and the second compartment 202 are moved towards one another about the hinged edge as shown in FIG. 5, it can be seen that this top panel 113 also serves as a top panel for the second compartment 202 as well.

Figure 6:
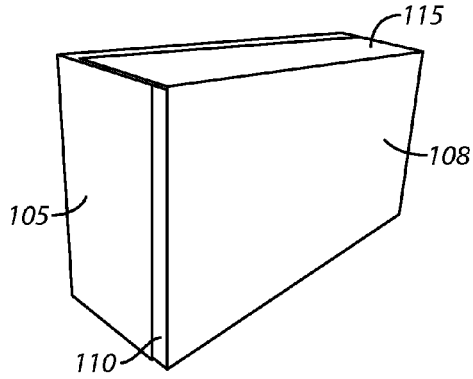
FIG. 6 comprises a perspective view as configured in accordance with various embodiments of the invention.

In this illustrative embodiment, and as shown in FIG. 1, the second compartment 202 further comprises an additional side panel 115. As shown in FIG. 6, this additional side panel 115 folds over to substantially enclose the second storage area 202. This additional side panel 115 can be retained in this closed position, if desired, by use of an affixment mechanism of choice (such as glue or a staple, brad, or the like).

If desired, one or more of the aforementioned end panels can be sized to provide a corresponding overlap with an opposing end panel. To illustrate by way of example, and referring to FIGS. 1, 5, and 6, it can be seen that the end panel 105 for the first compartment 103 extends outwardly considerably further than the corresponding end panel 110 for the second compartment 202. In the particular example shown, the former is more than twice the height of the latter. Such a configuration provides improved strength and resistance to deformation during use. Such an approach also aids in retaining the aforementioned products within the second compartment 202 when the carton is closed.

The applicant has determined that the foregoing teachings are amenable to a wide variety of variations that can, in turn, usefully accommodate a wide range of varying application settings. As a first illustrative example in these regards, and referring now to FIG. 7, the single-piece blank 100 can be somewhat differently configured to comprise, in this instance, providing the second compartment 202 with an outer side panel 801. As shown in FIGS. 8 and 9 this outer side panel 801 can be attached to its corresponding end panels 109 and 110 using tabs 112 or some other affixment mechanism.

Figure 7:
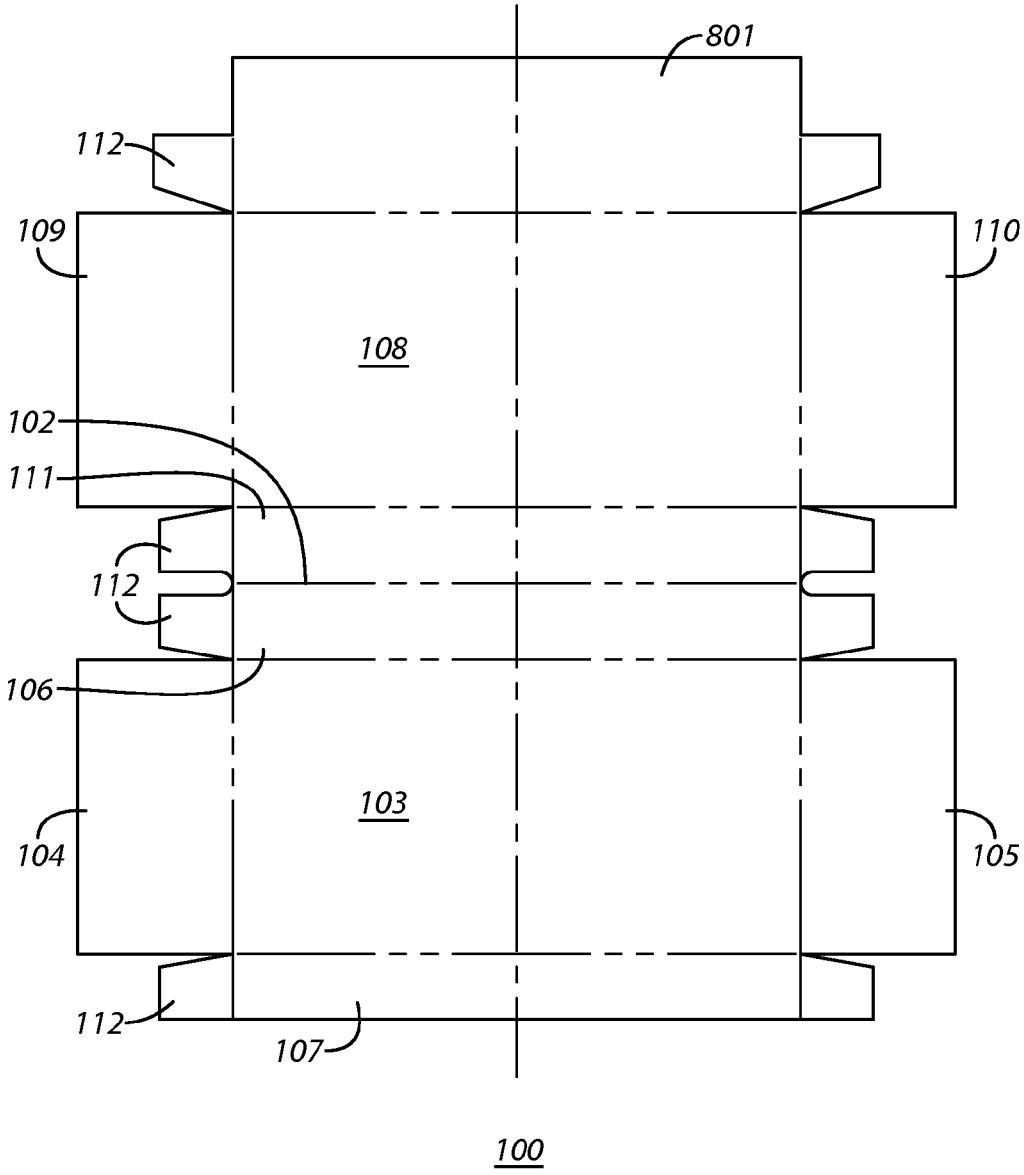
FIG. 7 comprises a top plan view as configured in accordance with various embodiments of the invention.
Figure 8:
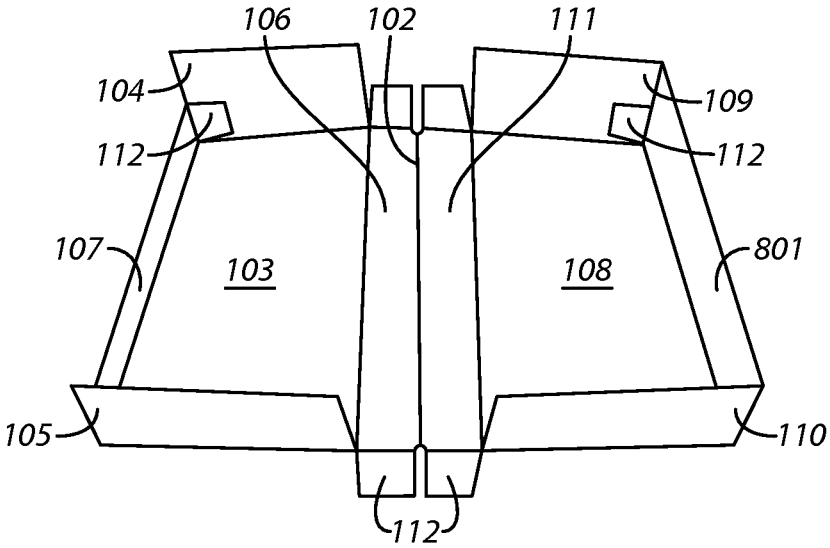
FIG. 8 comprises a perspective view as configured in accordance with various embodiments of the invention.
Figure 9:
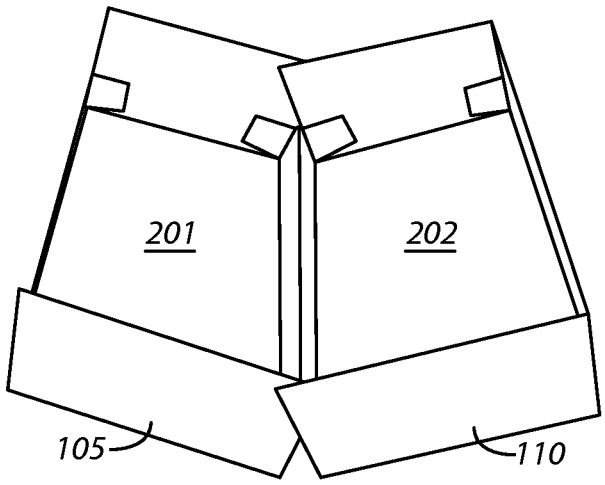
FIG. 9 comprises a perspective view as configured in accordance with various embodiments of the invention.
Figure 10:
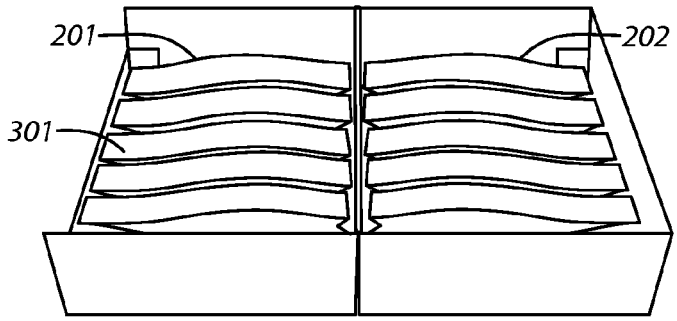
FIG. 10 comprises a perspective view as configured in accordance with various embodiments of the invention.
Figure 11:
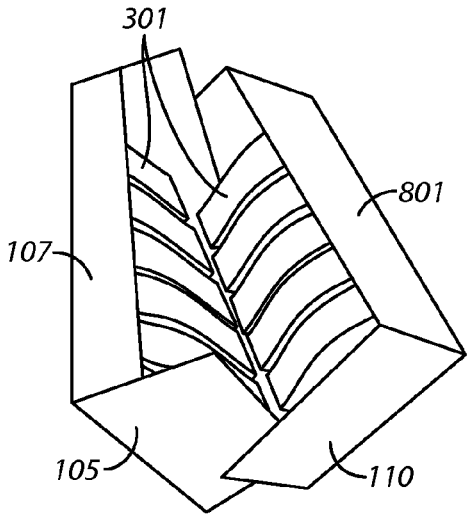
FIG. 11 comprises a perspective view as configured in accordance with various embodiments of the invention.
Figure 12:
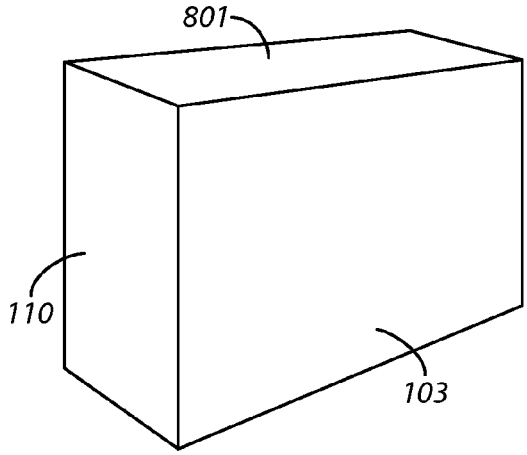
FIG. 12 comprises a perspective view as configured in accordance with various embodiments of the invention.

In this illustrative example, and as shown in FIGS. 7, 8, and 9, the end panels 104, 105, 109, and 100 and the aforementioned outer side panel 801 are all essentially of the same height while the outer side panel 107 for the first compartment 201 is only about half as high. As shown in FIG. 10 the resultant first and second compartments will readily serve to hold items 301 of interest. As shown in FIGS. 11 and 12, these two compartments can then be moved towards one another about the aforementioned hinged edge to a closed position. In this example, and as shown in FIG. 12, the outer side panel 801 for the second compartment 202 substantially overlaps the corresponding outer side panel 107 for the first compartment 201 to thereby aid in enclosing the aforementioned items 301 within the carton. If desired, an adhesive or other affixment mechanism can serve to secure the carton in this closed configuration.

Figure 13:
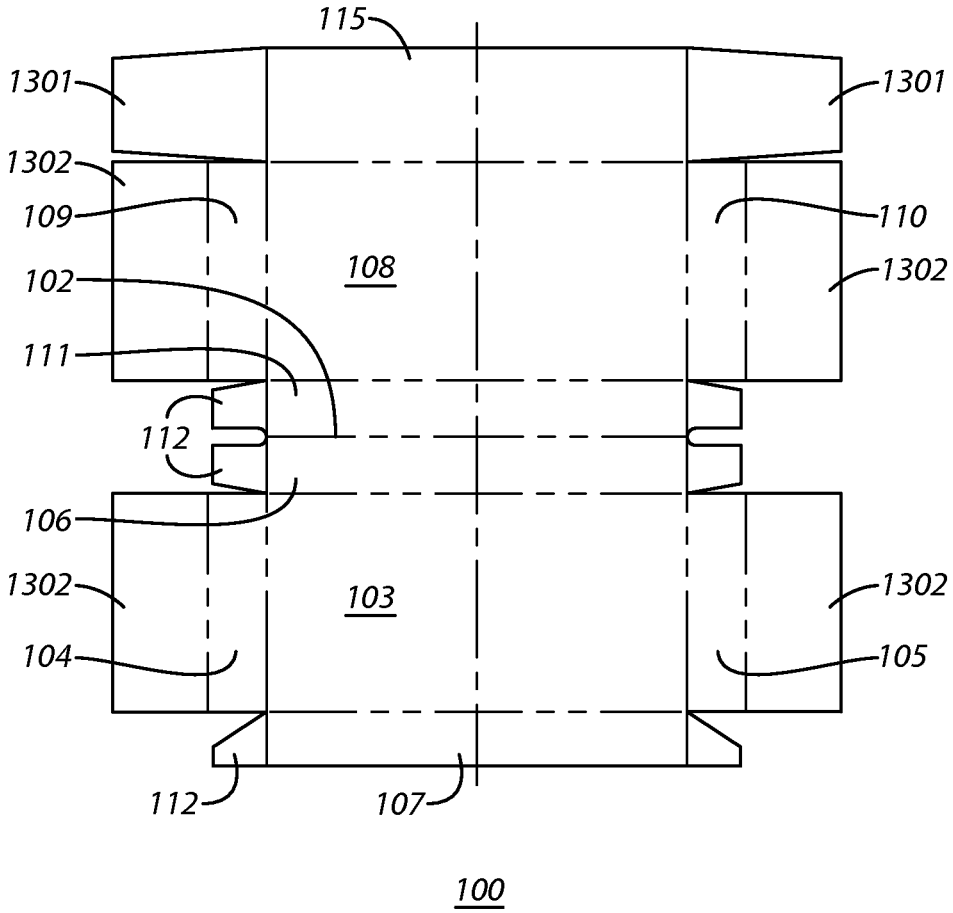
FIG. 13 comprises a top plan as configured in accordance with various embodiments of the invention.

Referring now to FIG. 13, another illustrative variation in these regards comprises a single-piece blank 100 wherein the aforementioned additional side panel 115 for the second compartment 202 has hinged wing panels 1301. In addition, in this particular example, the end panels 104, 105, 109, and 110 of the first and second compartments 201 and 202, respectively, each has a hinged flap 1302

Figure 14:
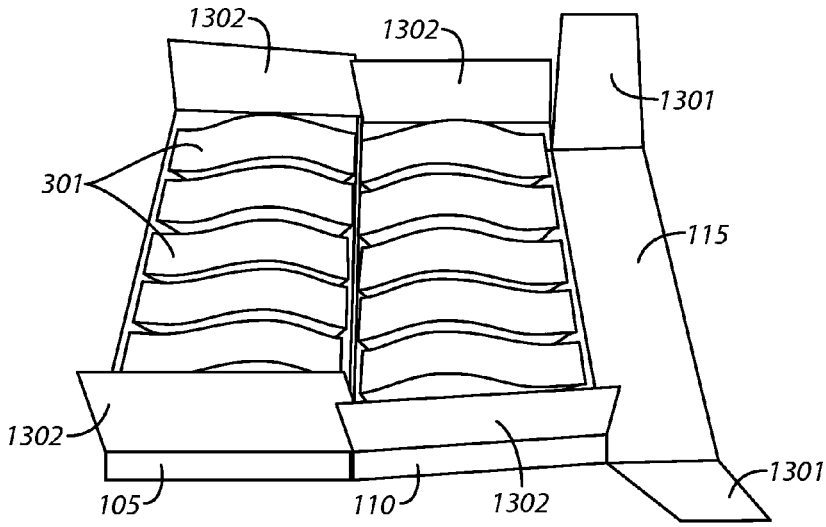
FIG. 14 comprises a perspective view as configured in accordance with various embodiments of the invention.
Figure 15:
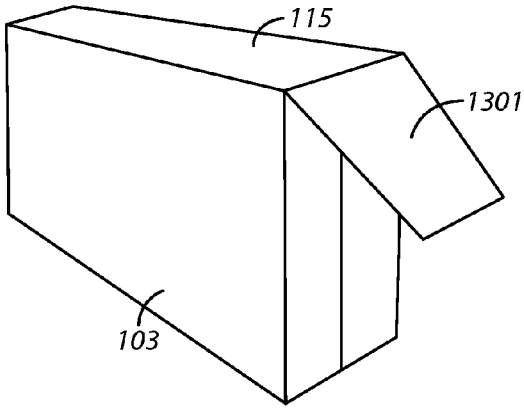
FIG. 15 comprises a perspective view as configured in accordance with various embodiments of the invention.
Figure 16:
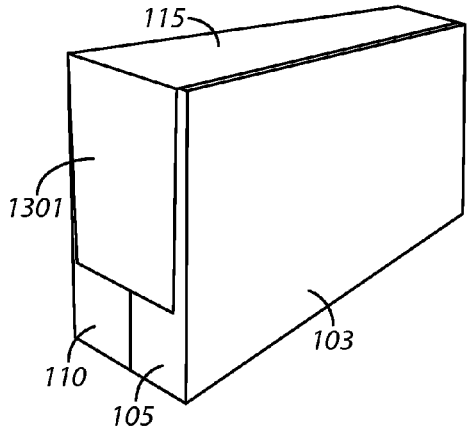
FIG. 16 comprises a perspective view as configured in accordance with various embodiments of the invention.

As shown in FIG. 14, the aforementioned hinged flaps 1302 have their hinge point sufficiently high so as to permit these hinged flaps 1302 to be folded down atop any items that may be disposed within the first and second compartments to thereby assist in retaining such items 301 when the carton is closed as shown in FIGS. 15 and 16. The aforementioned wing panels 1301 can then be folded down and attached to the side panels (such as side panels 105 and 110 shown in FIG. 16) using an adhesive or other affixment mechanism to thereby retain the carton in the closed configuration.

Figure 17:
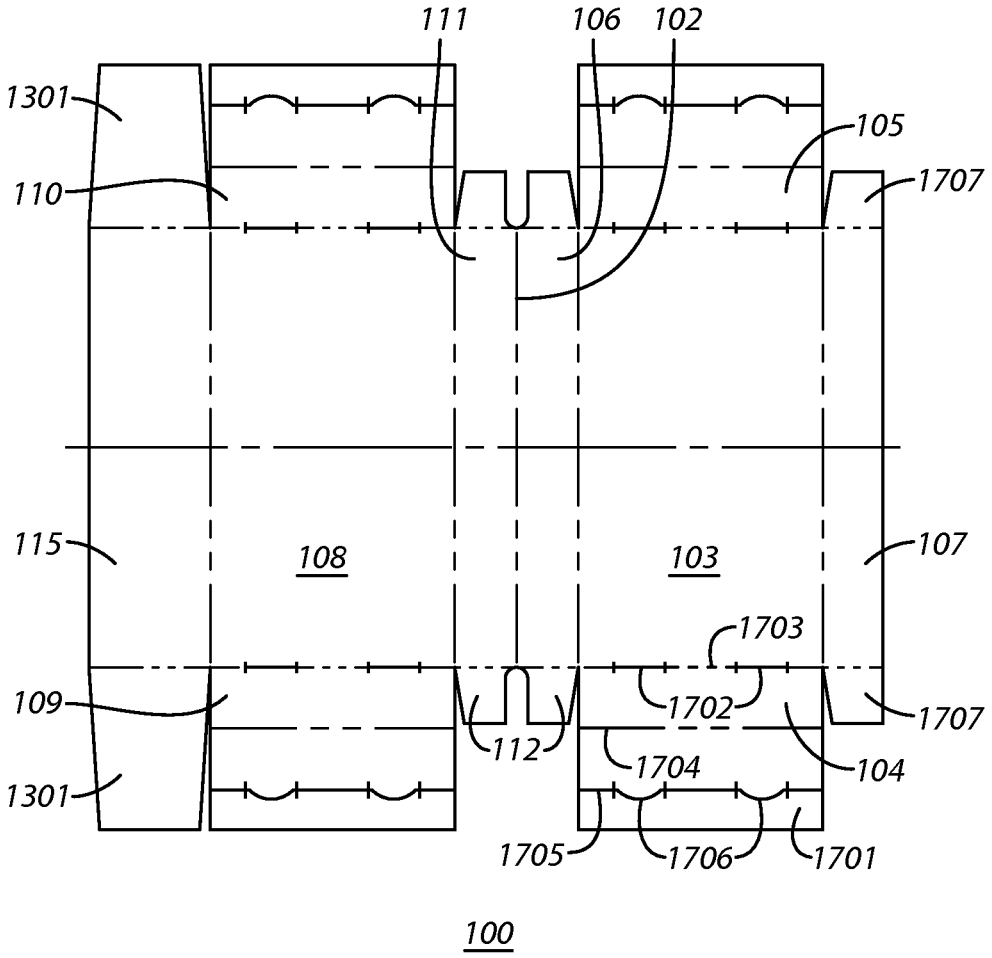
FIG. 17 comprises a top plan view as configured in accordance with various embodiments of the invention.
Figure 18:
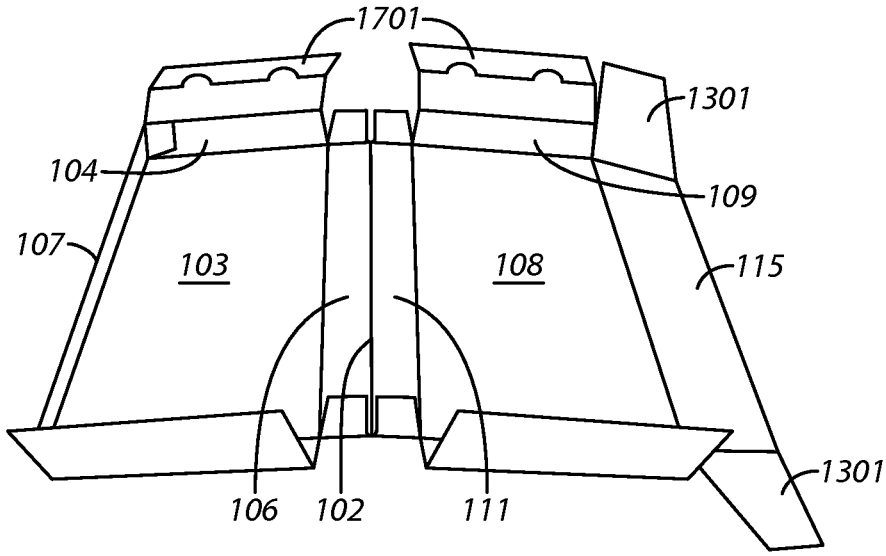
FIG. 18 comprises a perspective view as configured in accordance with various embodiments of the invention.

Referring now to FIGS. 17 and 18, yet another variation as pertains to these teachings will be described. In this approach, which is similar in ways to the approach described above with respect to FIG. 13, the end panels 104, 105, 109, and 110 each further comprise a double-fold end panel 1701. By this approach, and as per this particular illustrative example, a pair of notches 1702 are formed through the single-piece blank 100 at or near the fold line 1703 that separates the double-fold end panel 1701 from the bottom panel (for example, the bottom panel denoted by reference numeral 103). Each double-fold end panel 1701 includes two more transverse fold lines 1704 and 1705 with one of these fold lines 1705 being reverse scored in order to permit the blank to be folded in an opposite direction.

Figure 19:
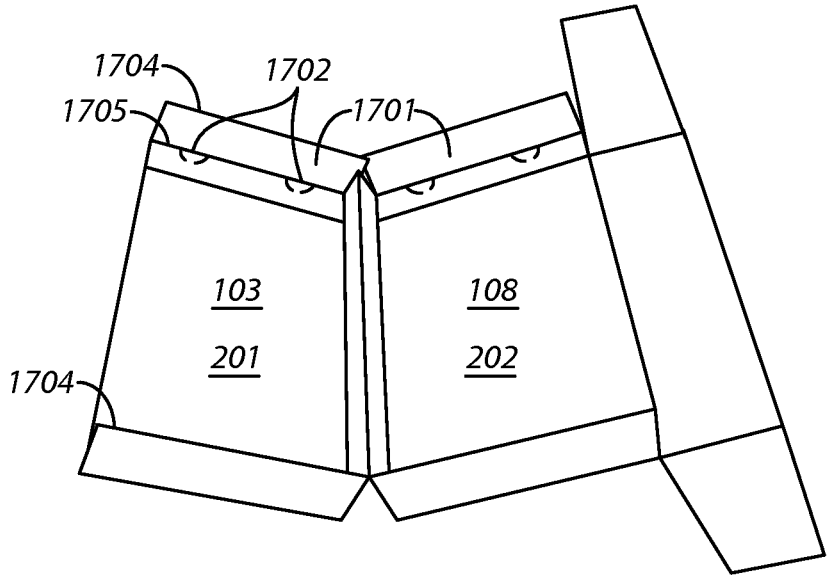
FIG. 19 comprises a perspective view as configured in accordance with various embodiments of the invention.

This reverse-scored fold line 1705 also includes two notched tabs 1706 that comprise, in this illustrative example, curved surfaces that are sized and positioned to mate with one of the aforementioned notches when the blank 100 is folded as shown in FIG. 19. So configured, the end panels for each compartment 201 and 202 are rigidly held in place without resorting to supplemental affixment mechanisms such as an adhesive. If desired, and as shown in FIG. 17, the side panel 107 for the first compartment 201 can have end tabs 1707 that can be disposed within the double-fold end panel 1701 into order to captivate the end tab 1707 and hence aid in holding this side panel 107 in place.

Figure 20:
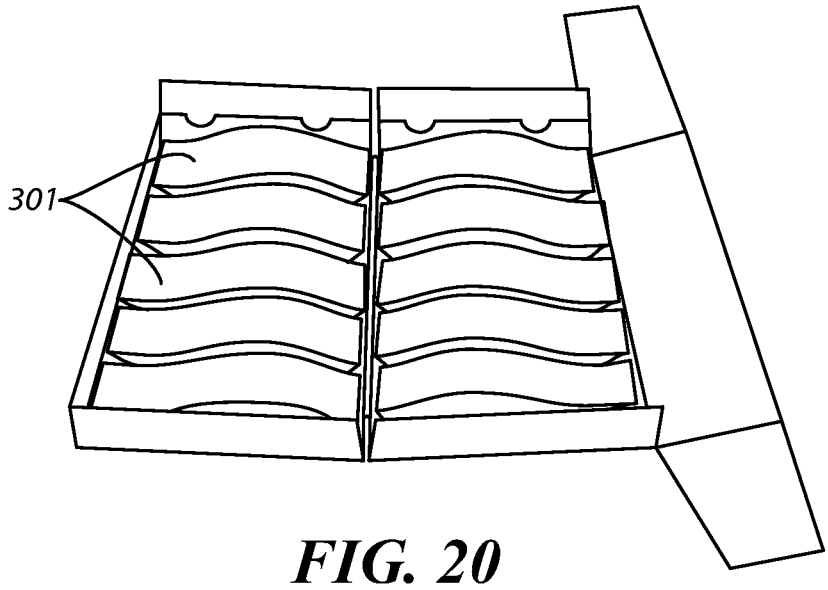
FIG. 20 comprises a perspective view as configured in accordance with various embodiments of the invention.
Figure 21:
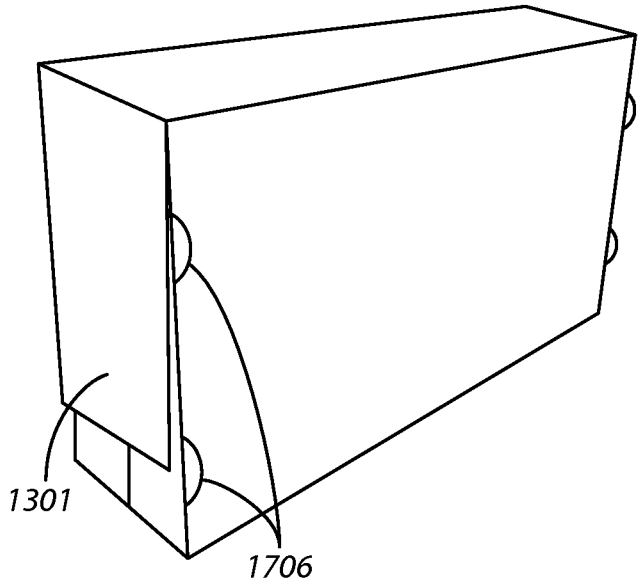
FIG. 21 comprises a perspective view as configured in accordance with various embodiments of the invention.

As shown in FIG. 20, the resultant compartments can again serve to contain a product of choice such as a plurality of individually packaged food items 301 as shown. As shown in FIG. 21, and as before, such a carton can be maintained in a closed position by adhering or otherwise affixing the hinged wing panels 1301 to the side panels.

Figure 22:
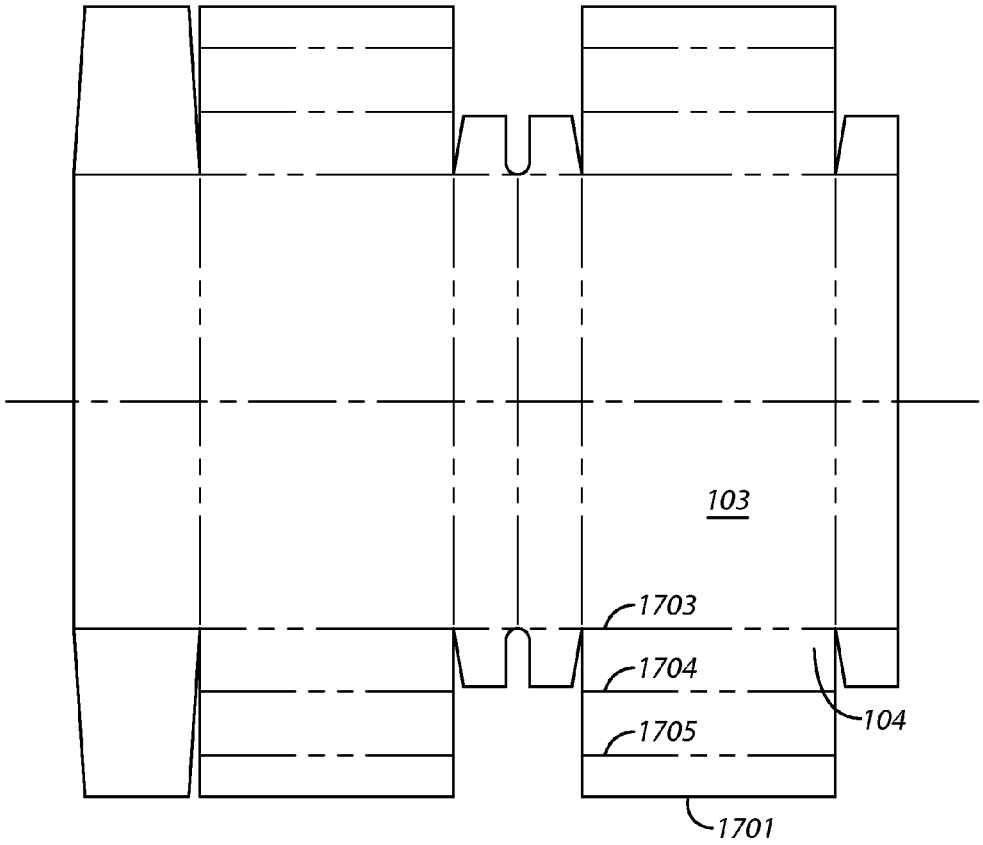
FIG. 22 comprises a top plan view as configured in accordance with various embodiments of the invention.

If desired, and as shown in FIG. 22, one or more of these double-fold end panels 1701 can be formed without the aforementioned notches or tabs. In this case, upon folding the end panel (such as the end panel denoted by reference numeral 104 in this figure) to appear as shown in FIG. 19 save for the interaction of the tabs/notches, this resultant configuration can be maintained as desired. In some cases, the material comprising the single-piece blank 100 may itself tend to hold the end panel 104 in this configuration. In other cases, an adhesive or affixment member may be utilized. In yet other cases the presence and/or weight of the items 301 being placed in the carton may be sufficient to hold the end panel 104 in this configuration.

So configured, a single-piece non-corrugated paperboard blank having a plurality of fold lines can be folded about those fold lines to form two compartments that each comprise a three-dimensional storage volume and a shared fold line that comprises a hinged edge. Pursuant to these teachings these two compartments can move with respect to one another about the hinged edge to thereby form a clamshell-style carton that is selectively movable between an opened position and a closed position. Generally speaking, when this carton is in the opened position, these two compartments are upwardly facing and are directly adjacent to and co-planar to one another. When in the closed position, these two compartments are still directly adjacent to one another but are now non-co-planar to one another.

Figure 23:
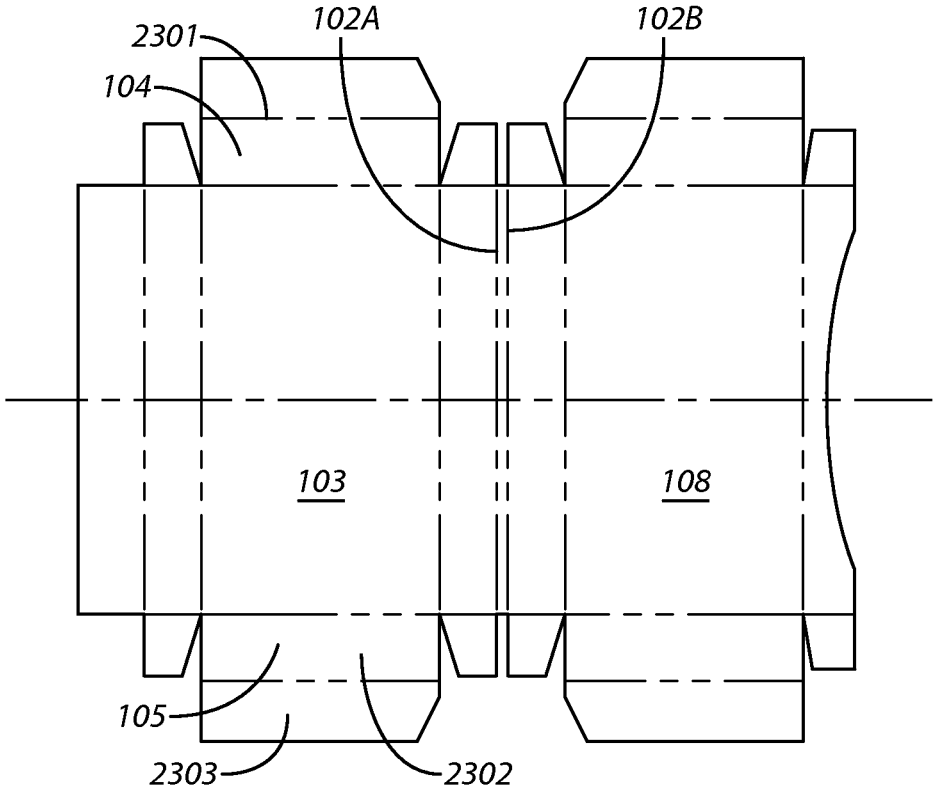
FIG. 23 comprises a top plan view as configured in accordance with various embodiments of the invention.
Figure 24:
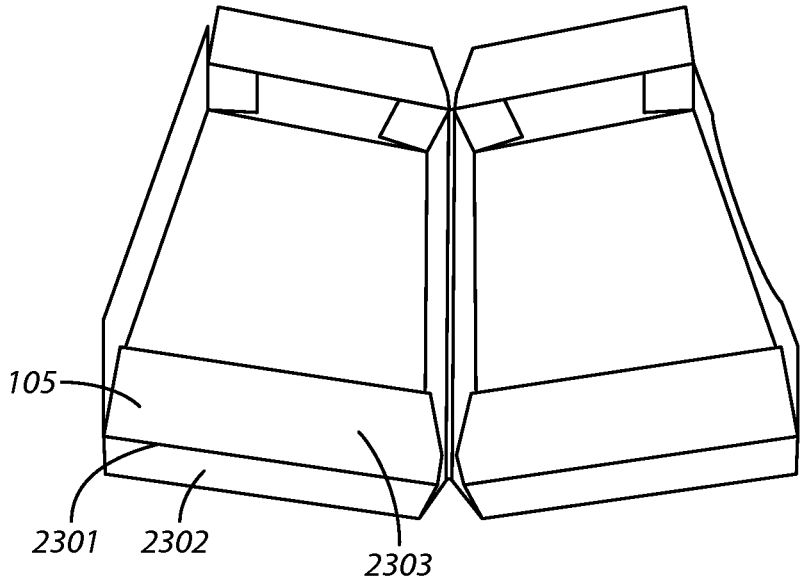
FIG. 24 comprises a perspective view as configured in accordance with various embodiments of the invention.

Referring now to FIGS. 23 and 24, yet another approach compliant with these teachings will be described. As illustrated here, the particular fold line 102 can comprise, if desired, two or more parallel fold lines 102A and 102B. This approach can form a central divider having an increased thickness or width that may be beneficial in some application settings.

Also as illustrated here, the end panels (such as the end panels denoted by reference numerals 104 and 105) can be comprised of two portions 2302 and 2303 separated by a fold line 2301. So configured, and as particularly illustrated in FIG. 24, the first portion 2302 of an end panel (such as end panel 105) forms a side of the resultant container while the second portion 2303 folds over at about a 90 degree angle with respect to the first portion 2302 to thereby effectively form a channel or I-beam. This, in turn, provides considerably increased compression strength and stability to the resultant container and particularly in a direction (i.e., top to bottom) in which such containers are properly stacked.

Those skilled in the art will appreciate that these teachings facilitate the use of non-corrugated materials in application settings where previously only corrugated materials would provide a necessary level of durability and strength. In particular, these various folds and flaps result in a considerable increase in the resultant carton's compression strength. For example, by applying these teachings a carton comprised of a single-piece blank having a thickness of less than 0.06 inches can nevertheless exhibit a compression strength of better than 150 pounds. This combination of strength coupled with thin, non-corrugated materials can lead in turn to significant savings as suitable cartons can be fashioned using considerably less expensive materials than have previously been the norm.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in these regards, one or more perforations can be provided in the single-piece blank 100 to facilitate later opening the carton. Generally speaking, it will be understood and appreciated that various of the points of specificity that have been set forth herein can be mixed and matched with one another to yield a wide variety of corresponding combinations and permutations.

I claim:

1. A carton formed of a single-piece blank along fold lines, the carton comprising:

a first compartment comprising a first storage area having a bottom panel, two opposing end panels, and two opposing side panels and having a fold line comprising a hinged edge;

a second compartment comprising a second storage area that provides approximately a same amount of storage space as the first storage area and having a bottom panel, two opposing end panels, and at least one side panel and also having the fold line that comprises the hinged edge, wherein at least one of the end panels for at least one of the first and second compartments is sufficiently large so as to substantially overlap with an opposing end panel when the carton is in the closed position;

wherein the first compartment and the second compartment move with respect to one another about the hinged edge to thereby form a clamshell-style carton.

2. The carton of claim 1 wherein the single-piece blank comprises paperboard.

3. The carton of claim 2 wherein the paperboard comprises non-corrugated paperboard.

4. The carton of claim 3 wherein the non-corrugated paperboard has a water-resistant coating disposed upon at least one side thereof.

5. The carton of claim 1 wherein:

the first compartment comprises a bottom panel, two opposing end panels, and two opposing side panels; and the second compartment comprises a bottom panel, two opposing end panels, and at least one side panel, wherein a fold line that joins the at least one side panel of the second compartment to one of the side panels of the first compartment comprises the fold line that comprises the hinged edge.

6. The carton of claim 5 wherein:

the first compartment further comprises a top panel that folds over to substantially cover the first storage area and that also serves as a top panel for the second compartment;

the second compartment further comprises an additional side panel that folds over to substantially enclose the second storage area.

7. The carton of claim 1 wherein:

the second compartment further comprises a side panel having hinged wing panels that fold down over the end panels when the carton is closed.

8. The carton of claim 5 wherein:

at least one of the end panels comprises a double-fold end panel.

9. The carton of claim 5 wherein:

at least one of the end panels comprises a first portion and a second portion, wherein the first portion comprises a side of a corresponding compartment and the second portion is disposed inwardly of the corresponding compartment at about 90 degrees to the first portion to thereby form a channel that increases compression strength of the carton.

10. A carton comprising:

a single-piece non-corrugated paperboard blank having a plurality of fold lines, wherein the single-piece blank is folded about the plurality of fold lines to form:

a first compartment comprising a first three-dimensional storage volume formed by a bottom panel, two opposing end panels, and two opposing side panels and having a fold line comprising a hinged edge;

a second compartment comprising a second three-dimensional storage volume formed by a bottom panel, two opposing end panels, and at least one side panel that provides approximately a same amount of storage space as the first three-dimensional storage volume and that also has the fold line that comprises the hinged edge, wherein at least one of the end panels for at least one of the first and second compartments is sufficiently large so as to substantially overlap with an opposing end panel when the carton is in the closed position;

such that the first compartment and the second compartment move with respect to one another about the hinged edge to thereby form a clamshell-style carton that is selectively movable between an opened position and a closed position, wherein:

in the opened position, the first and second compartments are upwardly facing and directly adjacent and co-planar to one another;

in the closed position, the first and second compartments are directly adjacent and non-co-planar to one another.

11. The carton of claim 10 wherein:

the first compartment further comprises a top panel that folds over to substantially cover the first storage area and that also serves as a top panel for the second compartment when the carton is in the closed position;

the second compartment further comprises an additional side panel that folds over to substantially enclose the second storage area when the carton is in the closed position.

12. The carton of claim 10 wherein:

the second compartment further comprises a side panel having hinged wing panels that fold down over the end panels when the carton is in the closed position.

13. The carton of claim 10 wherein:

at least one of the end panels comprises a double-fold end panel.

14. The carton of claim 10 wherein:

at least one of the end panels comprises a first portion and a second portion, wherein the first portion comprises a side of a corresponding compartment and the second portion is disposed inwardly of the corresponding compartment at about 90 degrees to the first portion to thereby form a channel that increases compression strength of the carton.

15. A single-piece blank having a plurality of fold lines, wherein the fold lines are oriented and positioned such that folding the single-piece blank along the plurality of fold lines forms:

a first compartment comprising a first storage area formed by a bottom panel, two opposing end panels, and two opposing side panels and having a fold line comprising a hinged edge;

a second compartment comprising a second storage area formed by a bottom panel, two opposing end panels, and at least one side panel that provides approximately a same amount of storage space as the first storage area and also having the fold line that comprises the hinged edge, wherein at least one of the end panels for at least one of the first and second compartments is sufficiently large so as to substantially overlap with an opposing end panel when the carton is in the closed position;

wherein the first compartment and the second compartment move with respect to one another about the hinged edge to thereby form a clamshell-style carton.

16. The single-piece blank of claim 15 wherein the single-piece blank comprises non-corrugated paperboard.

17. The single-piece blank of claim 15 wherein at least some of the fold lines comprise score lines having an inherent preferred direction of folding.

18. The single-piece blank of claim 15 further comprising a water-resistant coating that is disposed on at least one side of the single-piece blank.

19. The single-piece blank of claim 18 wherein the water-resistant coating comprises a clay-based coating.

* * * * *